United States Patent [19]

Pendock

[11] 4,055,319

[45] Oct. 25, 1977

[54] METAL PICTURE HANGER

[76] Inventor: Walter E. Pendock, 2910 Erie Blvd. East, Syracuse, N.Y. 13224

[21] Appl. No.: 707,359

[22] Filed: July 21, 1976

[51] Int. Cl.[2] ..... A47G 1/16

[52] U.S. Cl. ..... 248/491; 248/488

[58] Field of Search ..... 248/490, 491, 493, 489, 248/488

[56] References Cited

U.S. PATENT DOCUMENTS

| | | | |
|---|---|---|---|
| 1,056,636 | 3/1913 | Davison | 248/491 |
| 2,992,464 | 7/1961 | Muhlemann | 248/491 |
| 3,797,799 | 3/1974 | Maggia | 248/491 |

FOREIGN PATENT DOCUMENTS

| | | | |
|---|---|---|---|
| 8,173 of | 1903 | United Kingdom | 248/493 |
| 6,224 of | 1905 | United Kingdom | 248/493 |
| 170,752 | 11/1921 | United Kingdom | 248/493 |

*Primary Examiner*—Robert A. Hafer

*Attorney, Agent, or Firm*—Victor J. Evans & Co.

[57] ABSTRACT

A metal picture hanger including a metal channel along the top and bottom of the picture with these two channels connected by a wire and tension spring to pull them toward each other. A metal hanger is threaded on the wire for insertion over a nail driven in the wall.

1 Claim, 5 Drawing Figures

METAL PICTURE HANGER

BACKGROUND OF THE INVENTION

1. Field of the Invention

The present invention relates to a picture hanger for relatively heavy pictures.

2. Summary of the Invention

The present invention of a metal picture hanger includes metal channels placed over the top and bottom edges of the picture, with these two channels connected and pulled toward each other by means of a wire and a tension spring. Threaded onto the wire, and located a short distance from the top of the picture, there is a hanger card for insertion over a mounting nail to thereby post the picture on a wall.

The primary object of the invention is to provide a picture hanger that firmly and securely clamps onto a relatively heavy picture, backing, and glass cover.

Other objects and advantages will become apparent in the following specification when considered in light of the attached drawings.

DESCRIPTION OF THE PREFERRED EMBODIMENT

Figure 1:
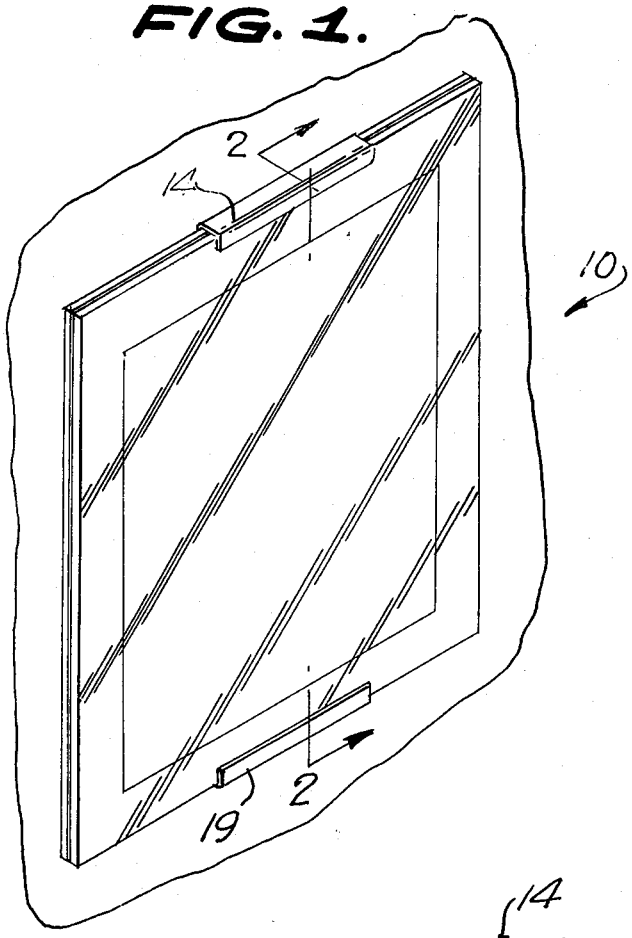
FIG. 1 is a perspective view of a picture as mounted with the invention.

Referring now to the drawings in detail wherein like reference characters indicate like parts throughout the several figures, the reference numeral 10 indicates generally the picture hanger making up the invention.

Figure 2:
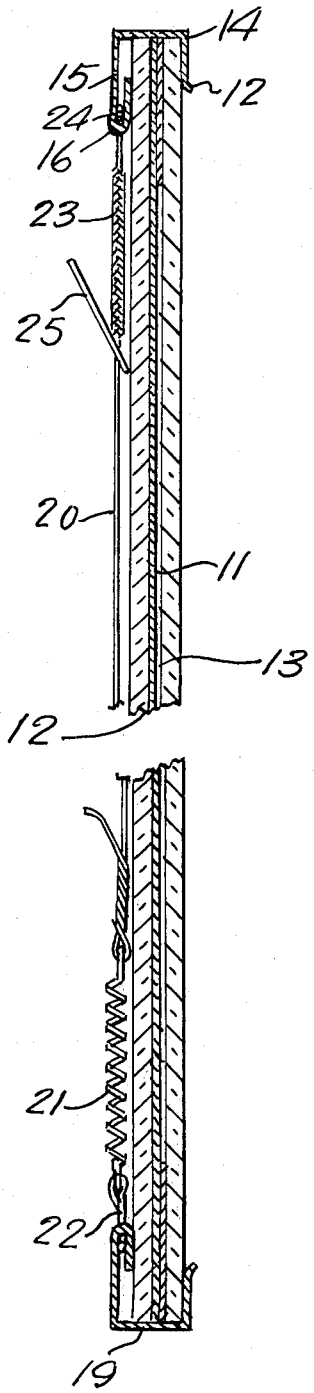
FIG. 2 is a view taken along the lines 2—2 of FIG. 1, looking in the direction of the arrows.
Figure 3:
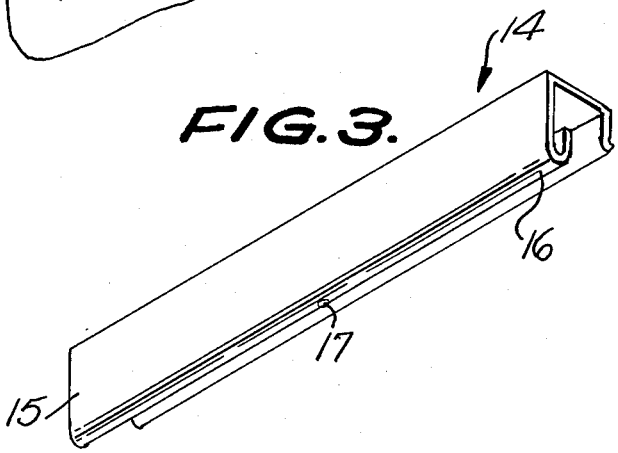
FIG. 3 is a perspective view of one of the end channels.
Figure 4:
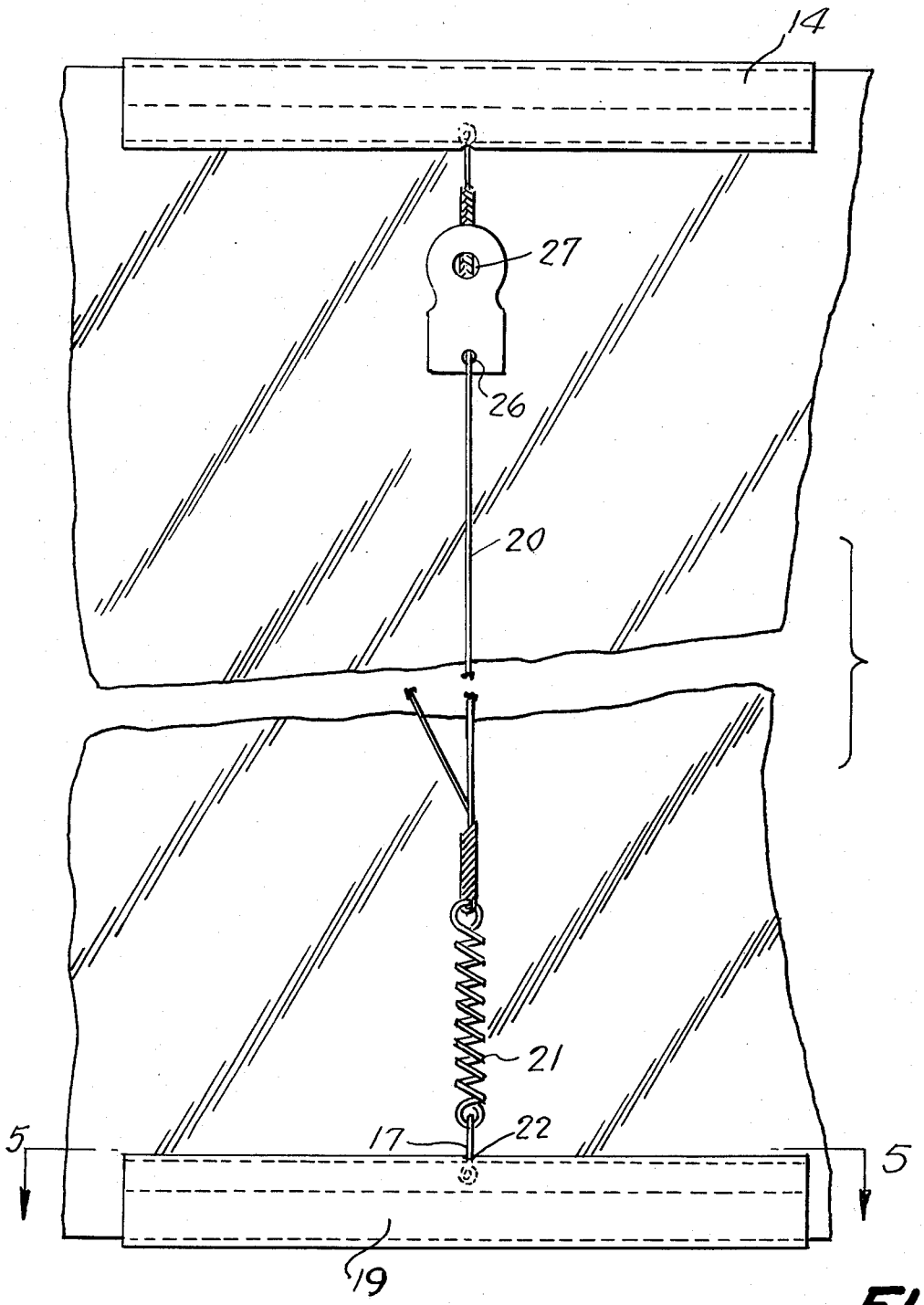
FIG. 4 is a back view showing the support wire and tension spring.
Figure 5:
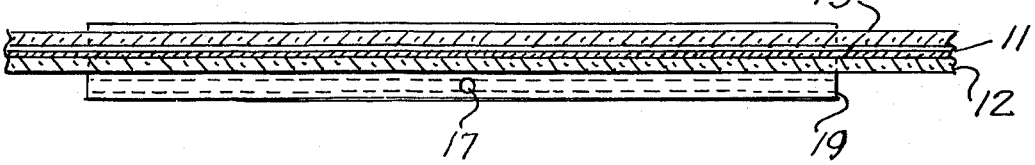
FIG. 5 is a view taken along the lines 5—5 of FIG. 4, looking in the direction of the arrows.

To be hung, there is a picture, photo, print, or the like 11, which is sandwiched in between a heavy cardboard backing 12 and a sheet of clear glass 13, resulting in somewhat of a laminated structure, as seen by FIGS. 2 and 5. It is common knowledge that a backing 12 adds support to a photo to keep it flat and stiff, while glass 13 not only protects the photo from handmarks, but at the same time permits it to be seen.

Across the top end of the picture 11, backing 12 and glass 13 there is placed a metal channel 14 which is substantially U-shaped and encompasses all of the components. The back arm 15, of channel 14 is slightly longer than the front arm and the extremity of its bends upward to form a hook 16. About the center of back arm 15 there is drilled a round hole 17, the purpose of which will be disclosed hereinafter. On the short front arm of channel 14 there is a slight outward curve 18 to facilitate placing the channel over the photo and its associated components.

In the various figures of the drawings it is clear that there is a bottom channel 19, located below the components. The structure of top channel 14 and bottom channel 19 is exactly the same so, for the sake of briefness a detailed description of 19 will not be elaborated on.

Joining channels 14 and 19 there is a wire 20 stretching between the two. The lower end of wire 20, however, has incorporated with it a tension spring 21, with the circular terminal 22 of the spring being threaded through the hole 17 drilled in the center of lower channel 19. Near the upper portion of the wire 20 there is a length of braid 23 wherein the wire itself is plaited to form a thickened area, with the final upper terminal 24 of the wire 20 passing through hole 17 in upper channel 14.

A hanger card 25, is mounted on the wire 20 for locating the picture on a wall nail. Card 25 has a small hole 26 in its lower end, through which wire 20 has been threaded, hole 26 being somewhat smaller than the diameter of braided portion 23. Near the upper end of card 25 there is a larger hole 27 for mounting over a wall nail, not shown.

In the use and operation of the invention, a photo or picture or chart 11 is placed with a heavy backing 12 and clear cover glass 13, to make a unit to be hung on the wall. A top end channel 14 is placed over these components, as is a bottom channel 19, to hold them together.

The upper end 24 of a wire 20 is then attached to hole 17 in channel 14 and loop 22 of tension spring 21 is fastened to bottom channel 19. The length of wire 20 is adjusted so that it is just a little shorter than the photo to thereby put a tension on spring 21 to hold the channels tightly in place.

Hanger card 25 has been threaded onto the wire 20, through hole 26, and the card pushed up to braided portion 23. It may be noted that the hanger card will not slide upward any further because hole 26 is smaller than the braid, and also because the card tips at a slight angle (FIG. 2) and so bites into the wire.

Having thus described the preferred embodiment of the invention it should be understood that numerous structural modifications and adaptations may be resorted to without departing from the spirit of the invention.

What is claimed is:

1. A metal picture hanger for holding a picture, stiff backing and cover glass comprising an elongate top U-shaped channel having front and rear spaced parallel legs with the rear leg internally reverted to form a hook, said top channel adapted to enclose the top edges of said picture, said backing and said glass, an elongate bottom U-shaped channel having front and rear spaced parallel legs with the rear leg internally reverted to form a hook, said bottom channel adapted to enclose the bottom edges of said picture, said backing and said glass, a wire secured at one end to the hook of one of said channels, a tension spring secured at one end to said wire and at the opposite end to the other of said channels, said spring and said wire securing said channels against disengagement, a braided portion adjacent the upper end of said wire, a hanger card threaded on said wire and engaging said braided portion, said card having a hole to receive a mounting nail for hanging the picture on a wall.

* * * * *